US006971587B2

(12) United States Patent
Boehland et al.

(10) Patent No.: US 6,971,587 B2
(45) Date of Patent: Dec. 6, 2005

(54) FUEL INJECTION SYSTEM FOR DIRECT INJECTION INTERNAL COMBUSTION ENGINE

(75) Inventors: Peter Boehland, Marbach (DE); Sebastian Kanne, Schwaikheim (DE)

(73) Assignee: Robert Bosch GmbH, Stuttgart (DE)

( * ) Notice: Subject to any disclaimer, the term of this patent is extended or adjusted under 35 U.S.C. 154(b) by 161 days.

(21) Appl. No.: 10/433,279

(22) PCT Filed: Sep. 6, 2002

(86) PCT No.: PCT/DE02/03318

§ 371 (c)(1),
(2), (4) Date: Jun. 2, 2003

(87) PCT Pub. No.: WO03/031800

PCT Pub. Date: Apr. 17, 2003

(65) Prior Publication Data

US 2004/0188536 A1 Sep. 30, 2004

(30) Foreign Application Priority Data

Oct. 2, 2001 (DE) ..... 101 48 650

(51) Int. Cl.[7] ..... F02M 47/02; F02M 59/00; F02M 39/00; B05B 1/30

(52) U.S. Cl. ..... 239/88; 239/533.3; 239/533.2; 239/533.12; 239/585.1; 239/585.4; 239/585.5

(58) Field of Search ..... 239/88–93, 533.2, 239/533.3, 533.9, 533.12, 581.1–585.5; 251/127, 251/129.15, 129.21

(56) References Cited

U.S. PATENT DOCUMENTS

| | | | | |
|---|---|---|---|---|
| 4,046,112 A | * | 9/1977 | Deckard | 239/96 |
| 4,349,152 A | * | 9/1982 | Akagi | 239/96 |
| 4,544,096 A | | 10/1985 | Burnett | |
| 4,957,085 A | * | 9/1990 | Sverdlin | 123/467 |
| 5,241,935 A | * | 9/1993 | Beck et al. | 123/300 |
| 5,413,076 A | * | 5/1995 | Koenigswieser et al. | 123/446 |
| 5,526,792 A | | 6/1996 | Guth et al. | |

FOREIGN PATENT DOCUMENTS

FR 913 174 A 8/1946

* cited by examiner

*Primary Examiner*—Davis Hwu
(74) *Attorney, Agent, or Firm*—Ronald E. Greigg

(57) ABSTRACT

A fuel injection system for an internal combustion engine with direct injection includes a fuel injection device which can inject the fuel directly into a combustion chamber of the engine has a valve element bordering on a work chamber, and the position of the valve element depends on the pressure in the work chamber. A pressure booster piston borders on a control chamber on one side and on a high-pressure chamber on the other. A fuel supply can subject the control chamber to various pressures. The pressure booster piston is integrated with the fuel injection device and that the high-pressure chamber is integrated with the work chamber.

20 Claims, 6 Drawing Sheets

10
34
16
18
30
36
24
32
38
26
20
22
28
14
12

FUEL INJECTION SYSTEM FOR DIRECT INJECTION INTERNAL COMBUSTION ENGINE

CROSS-REFERENCE TO RELATED APPLICATIONS

This application is a 35 USC 371 application of PCT/DE 02/03318 filed on Sep. 6, 2002.

BACKGROUND OF THE INVENTION

1. Field of the Invention

The invention relates to a fuel injection system for an internal combustion engine with direct injection, having a fuel injection device which can inject the fuel directly into a combustion chamber of the engine and a valve element which borders on a work chamber, and the position of the valve element depends on the pressure in the work chamber; having a pressure booster piston, which on one side borders on a control chamber and on the other side borders on a high-pressure chamber; and having a fuel supply, which can subject the control chamber to various pressures.

2. Description of the Prior Art

One fuel injection system, known from German Patent Disclosure DE 199 45 785 A1, includes a fuel pump which has a high-pressure and a low-pressure outlet. The highpressure outlet communicates with a control chamber of a pressure booster device. A high-pressure chamber of the pressure booster device communicates via a check valve with the low-pressure outlet of the fuel pump. A high-pressure line leads from the high-pressure chamber to a work chamber of a fuel injection device, by way of which the pressure is transmitted from the high-pressure chamber into this work chamber. Depending on the pressure in the high-pressure chamber or in the work chamber, a valve element of the fuel injection device is moved from a closed position to an opened position, or vice versa. The advantage of a pressure booster device or a hydraulic booster device is primarily that a relatively simple fuel pump can be used, yet the fuel can still be injected at very high pressure into a combustion chamber of the engine. This is important for the sake of favorable emissions performance of the engine.

From German Patent Disclosure DE 197 38 804 A1, a fuel injection system with a hydraulic booster device is likewise known. In it as well, the hydraulic booster device communicates with the fuel injection device via a high-pressure line.

The object of the present invention is to further develop a fuel injection system of the type defined at the outset such that when it is used, the emissions performance of the engine is even better, and as little energy as possible is needed to operate the fuel injection system. The temperature of the fuel injection device in operation should also be as low as possible.

This object is attained, in a fuel injection system of the type defined at the outset, in that the pressure booster piston is integrated with the fuel injection device, and the high-pressure chamber is integrated with the work chamber.

SUMMARY OF THE INVENTION

By integrating the pressure booster piston with the fuel injection device and the high-pressure chamber with the work chamber, a separate high-pressure line that leads from the pressure booster device to the fuel injection device is no longer necessary. As a result, the total volume to be compressed by the pressure booster device is reduced.

This accelerates the motion of the pressure booster piston in both directions, and as a consequence speeds up the buildup (and reduction) of the pressure in the high-pressure chamber. This in turn prevents fuel, for instance at the onset or end of an injection, from reaching the combustion chamber of the engine with only little pressure or little impetus. The high impetus with which the fuel in the fuel injection system of the invention is injected leads to an improvement in the emissions performance of the engine.

The energy to be brought to bear to operate the fuel injection system of the invention is also relatively slight, since because of the reduced volume that has to be compressed and expanded, only slight energy losses occur upon this compression and expansion. This also lessens the unwanted heating of the fuel injection device during its operation, since less entropy occurs in the compression and decompression work of the fuel.

The pumping volume that has to be furnished for compressing the fuel in the high-pressure chamber is also less, so that a fuel supply with less capacity can be provided. The loads on all the components used in the fuel injection system are also reduced, since the high pressure is now applied to essentially only in the combined high-pressure and work chamber. Less-expensive components can therefore be used for producing the fuel injection system of the invention.

In a first refinement, the pressure booster piston is disposed coaxially to the valve element. A fuel injection device of this kind is relatively compact, above all in the radial direction.

In a refinement of this, the valve element is guided in the pressure booster piston. This additionally has the advantage that the axial dimensions of the fuel injection device can also be kept comparatively slight. Moreover, because of the pressure booster piston, guidance for the valve element is created, so that the valve element cooperates very precisely with a valve seat assigned to it.

It is also advantageous if a longitudinal bore, by which the high-pressure chamber is supplied with fuel, is present in the valve element. This leads to a further reduction in the radial size of the fuel injection device that is used in the fuel injection system of the invention.

In an especially preferred feature of the fuel injection system of the invention, a check valve which opens toward the high-pressure chamber is present between the longitudinal bore in the valve element and the high-pressure chamber. Such a check valve is very simple in structure and assures that the highpressure chamber is reliably disconnected from the fuel supply during a compression. This is highly advantageous for the function of the pressure booster. The disposition near the high-pressure chamber reduces the loads on the longitudinal bore in operation, so that an inexpensive material can be selected for the valve element.

The longitudinal bore in the valve element can communicate with a low-pressure fuel supply. Thus whenever a high pressure does not prevail in the high-pressure chamber, the high-pressure chamber can be supplied with fuel that is available at a uniform, low pressure. Filling of the high-pressure chamber with fuel thus takes place uniformly and securely, and the loads on the longitudinal bore and thus on the valve element are kept slight.

As an alternative to this, it is possible that the longitudinal bore in the valve element communicates with a high-pressure fuel supply, which can also subject the control chamber to various pressures. In this case, a separate low-pressure fuel supply can be dispensed with. This reduces the costs of the fuel injection system of the invention. Moreover, incorporating this system into an internal combustion engine is facilitated, since it is no longer necessary to manipulate a separate low-pressure line.

For concrete realization of this, it is proposed that the control chamber coaxially surrounds the valve element, and that the longitudinal bore in the valve element communicates with the control chamber via a radially extending opening. This is space-saving and can be produced economically.

In a further variant, the pressure booster piston is braced via a spring on a nozzle body of the fuel injection device. The effect of this is that the pressure booster piston is reliably urged into its outset position.

A hollow chamber, which is present between the pressure booster piston and the nozzle body and is variable in volume upon a motion of the pressure booster piston, preferably communicates with a leak fluid outlet via a check valve, and the check valve opens toward the leak fluid outlet. The spring that acts on the pressure booster piston can for instance be accommodated in such a hollow chamber.

By means of the leak fluid outlet with the check valve, upon the first stroke of the pressure booster piston, any fuel present in the hollow chamber is pumped toward the leak fluid outlet. In all the further strokes of the pressure booster piston, then only the remaining fuel vapor in the hollow chamber has to be compressed, and any leakage that may occur between injections is pumped to a leakage removal line. As a result, pressure fluctuations in the low-pressure loop are avoided, and the energy expenditure needed to operate the fuel injection system of the invention is reduced still further.

It is also possible for the control chamber to be capable of being made to communicate via a check valve with a low-pressure fuel supply, where the check valve opens toward the control chamber. If in iperation the minimal pressure in the control chamber is below the pressure furnished by the low-pressure fuel supply, then when the minimal pressure in the control chamber is reached, the check valve is opened, and a slight quantity of fuel flows from the low-pressure fuel supply into the control chamber.

This is based on the following thought: The fluid located in the control chamber is constantly being compressed and decompressed again by the high-pressure fuel supply. This creates entropy or heat, which causes heating of the entire fuel injection device. This can impair the functioning of the fuel injection device. Because in the refinement proposed here "fresh" and thus cool fuel constantly reaches the control chamber from the low-pressure fuel supply, the temperature of the fuel located in the control chamber is lowered, and the overall heating of the fuel injection device in operation of the fuel injection system of the invention is reduced.

BRIEF DESCRIPTION OF THE DRAWINGS

Preferred exemplary embodiments of the present invention are described in detail herein below, in conjunction with the accompanying drawings, in which.

DESCRIPTION OF THE PREFERRED EMBODIMENTS

Figure 1:
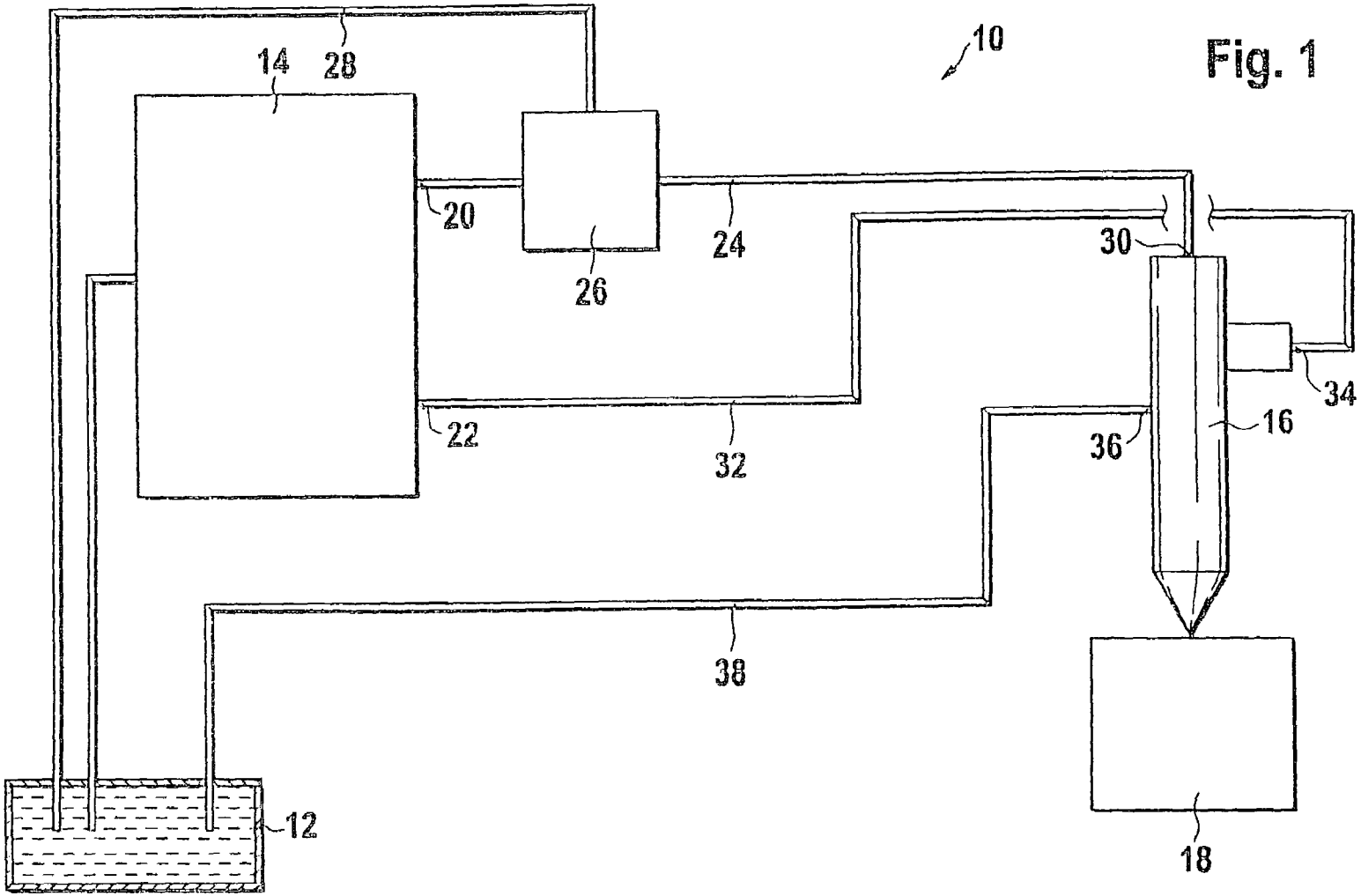
FIG. 1 is a basic sketch of a first exemplary embodiment of a fuel injection system for an internal combustion engine with a fuel injection device.

In FIG. 1, a fuel injection system according to the invention is identified overall by reference numeral 10 and includes a fuel tank 12, from which a fuel pump 14 pumps the fuel to a fuel injection device 16. The fuel injection device is an injector that injects the fuel directly into a combustion chamber 18 of an internal combustion engine (not further shown).

The fuel pump 14 includes a control pressure outlet 20 and a low-pressure outlet 22. A control pressure line 24 is connected to the control pressure outlet 20. A control valve 26 is disposed in the control pressure line. From the control valve 26, a diversion line 28 leads back to the fuel tank 12. The control pressure line 24 leads to a control pressure connection 30 on the fuel injection device 16. The control valve 26 should be switched such that in one switching position, the control pressure outlet 20 of the fuel pump 14 communicates with the control pressure connection 30 of the fuel injection device 16, while conversely in another switching position of the control valve 26, the control pressure connection 30 communicates with the fuel tank 12 via the diversion line 28.

From the low-pressure outlet 22 of the fuel pump 14, a low-pressure line 32 leads to a low-pressure connection 34 on the fuel injection device 16. A leak fluid line 38 leads from a leak fluid outlet 36 of the fuel injection device 16 back to the fuel tank 12.

Figure 2:
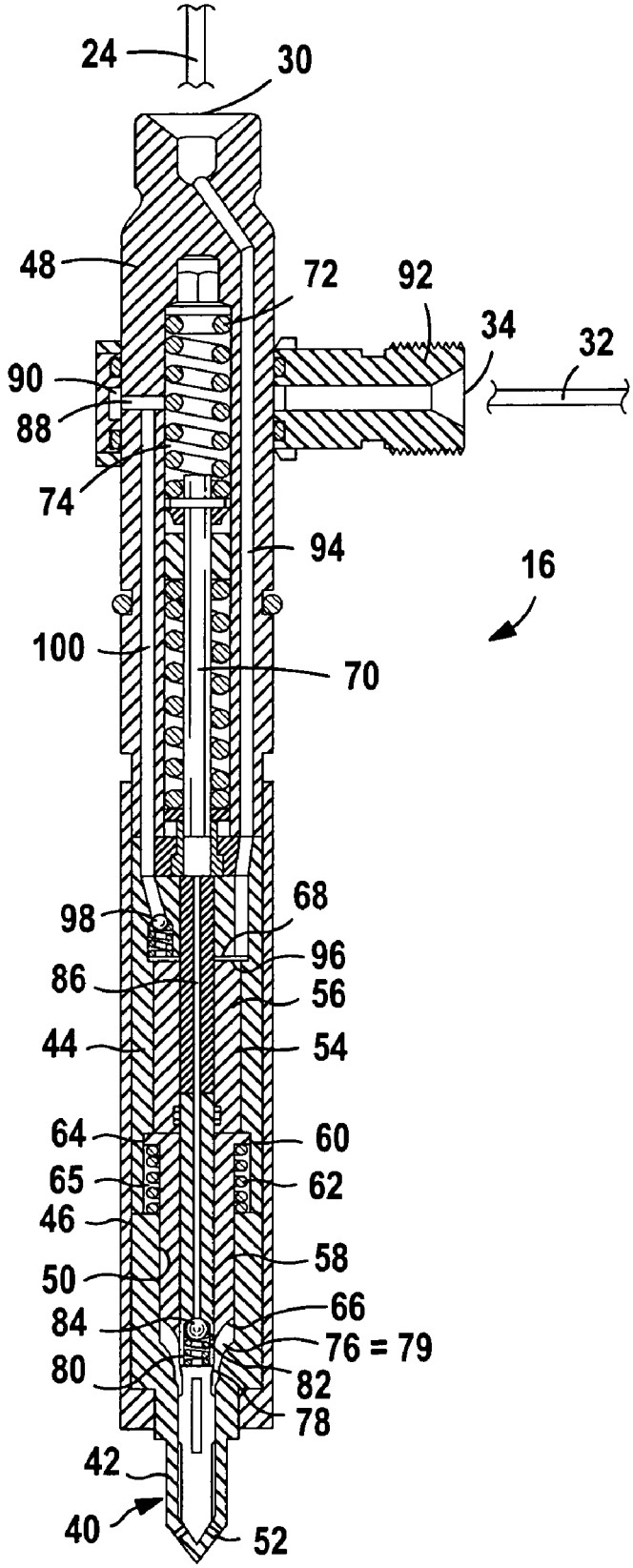
FIG. 2, a fragmentary section through the fuel injection device of FIG. 1, with a pressure booster piston in a first position.
Figure 3:
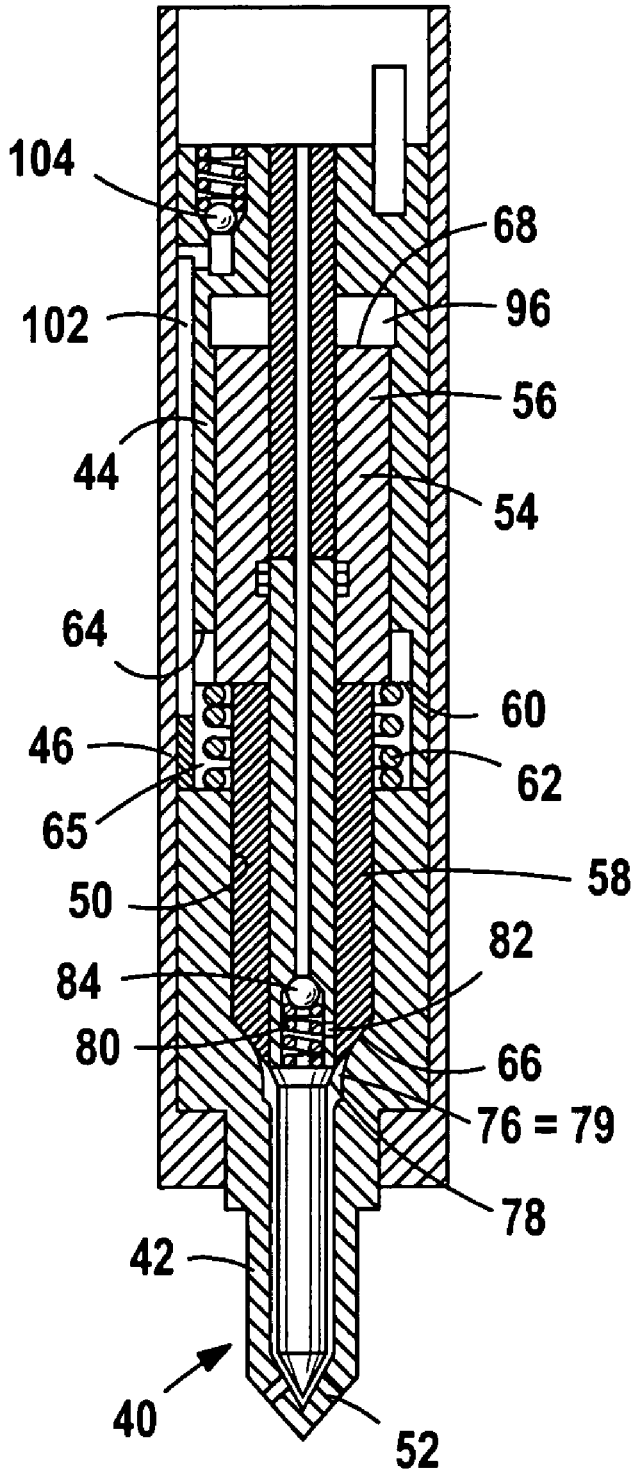
FIG. 3, a view similar to FIG. 2 of a region of the fuel injection device of FIG. 1 with the pressure booster piston in a second position.

The precise structure of the fuel injection device 16 can be seen from FIGS. 2 and 3 where it is seen that the fuel injection device 16 includes a nozzle body 40, which comprises a lower part 42, in terms of FIGS. 2 and 3, and an upper part 44 which is braced by a nozzle lock nut 46 against a connection part 48. The upper part 44 of the nozzle body 40 is sleevelike. The lower part 42 of the nozzle body 40 has a stepped blind bore 50. On the lower end, in terms of FIG. 2, of the lower part 42 of the nozzle body 40, outlet openings 52 lead to the outside from the blind bore 50. All the parts described thus far are furthermore rotationally symmetrical parts of circular-cylindrical cross section.

In the blind bore 50 of the lower part 42 of the nozzle body 40 and in the sleevelike upper part 44 of the nozzle body 40, a pressure booster piston 54 is received axially displaceably with sliding play. This part likewise comprises an upper part 56 and a lower part 58, in terms of FIG. 2. An annular collar 60 is formed onto the upper end of the lower part 58 of the pressure booster piston 54. A compression spring 62 is braced on the annular collar, and its other end rests on the lower part 42 of the nozzle body 40. The compression spring 62 urges the lower part 58 of the pressure booster piston 54, with the annular collar 60, against a shoulder 64 in the upper part 44 of the nozzle body 40. The compression spring 62 is received in an annular chamber 65. A lower axial end face 66, that is, lower in terms of FIG. 2, on the lower part 58 of the pressure booster piston 54 is smaller overall than an upper axial end face 68 on the upper part 56 of the pressure booster piston 54.

The pressure booster piston 54 is penetrated by a recess. A portion of a valve needle 70 is guided in the recess, and this valve needle cooperates with a valve seat (not identified by reference numeral) on the lower end of the blind bore 50, in the region of the outlet openings 52. The valve needle 70 and the pressure booster piston 54 are thus disposed coaxially to one another. The valve needle 70 extends through the pressure booster piston 54, upward in terms of FIG. 2, into a blind bore 74 in the connection part 48 of the fuel injection device 16. Between the upper end, in terms of FIG. 2, of the valve needle 70 and the end of the blind 74, a compression spring 72 is fastened that urges the valve needle 70 against the valve seat in the region of the outlet openings 52, or in other words in the closing direction.

The axial length of the lower part 58 of the pressure booster piston 54 is dimensioned such that the pressure booster piston 54, in the upper outset position shown in FIG. 2, ends at the bottom before a cross-sectional narrowing (not identified by reference numeral) of the stepped blind bore 50 in the nozzle body 40. An annular high-pressure chamber 76 is formed between the valve needle 70, the lower end face 66 of the pressure booster piston 54, and the wall of the stepped blind bore 50 in the nozzle body 40.

The valve needle 70 extends through the high-pressure chamber 76. In the region of the high-pressure chamber 76, there is a cross-sectional enlargement on the valve needle 70 that forms a pressure face 78, whose force resultant opposes the pressure force exerted by the compression spring 72, or in other words points in the opening direction of the valve needle 70. The space surrounding the pressure face is called the work chamber 79. It coincides with the high-pressure chamber 76. From the high-pressure chamber 76, an annular chamber (not identified by reference numeral), which is formed between the valve needle 70 and the lower region of the blind bore 50 in the nozzle body 40, extends as far as the valve seat, that is, the outlet openings 52.

In the valve needle 70, a radial bore 82 extends into the high-pressure chamber 76 from a spring chamber 80 that is located in the valve needle 70 in the region of the high-pressure chamber 76. A spring-loaded check valve 84 that opens toward the spring chamber 80 is disposed in the spring chamber 80. From the check valve 84, a low-pressure conduit 86 that is coaxial with the longitudinal axis of the valve needle 70 extends in the valve needle 70 as far as the upper end, in terms of FIG. 2, of the valve needle 70, where it discharges into the blind bore 74 in the connection part 48. The blind bore 74 communicates, via a radial bore 88 in the wall of the connection part 48, with an annular conduit 90 in a connecting part 92. The connecting part, via the low-pressure connection 34, establishes a communication with the low-pressure line 32.

From the control pressure connection 30, which in terms of FIG. 2 is located at the upper end of the connection part 48, an overall eccentric control conduit 94 leads to a control chamber 96. This control chamber 96 is formed as an annular chamber between the upper axial end face 68 of the pressure booster piston 54, the outer jacket face of the valve needle 70, and the connecting part 48 of the nozzle body 40 and is thus disposed coaxially with the valve needle 70. Via a springloaded check valve 98 that opens toward the control chamber 96, the control chamber communicates with a scavenging conduit 100 that discharges into the radial bore 88 in the connection part 48.

In FIG. 3, the lower part of the fuel injection device 16 is shown. The view in FIG. 3 is rotated by 90° about the longitudinal axis of the fuel injection device 16, compared to FIG. 2. Moreover, in FIG. 3 the pressure booster piston 54 is in its lower end position, while conversely in FIG. 2 it is in its upper outset position.

As can be seen from FIG. 3, from the boundary region between the annular collar 60 on the lower part 58 of the pressure booster piston 54 and the shoulder 64 of the upper part 44 of the nozzle body 40, a longitudinal groove 102 leads between the nozzle lock nut 46 and the upper part 44 of the nozzle body 40. It leads to a spring-loaded check valve 104. The check valve blocks in the direction toward the longitudinal groove 102. From the check valve 104, a conduit not shown in the drawing leads to the leak fluid outlet 36.

The fuel injection system 10 shown in FIGS. 1–3 functions as follows:

Before an injection of fuel into the combustion chamber 18 by the fuel injection device 16, the high-pressure chamber 76 is filled with fuel. To that end, fuel is pumped from the low-pressure outlet 22 of the fuel pump 14 to the low-pressure connection 34 of the fuel injection device 16. From there, the fuel reaches the high-pressure chamber 76, via the low-pressure conduit 86 in the valve needle 70, the check valve 84, the spring chamber 80, and the conduit 82. Once the pressure in the high-pressure chamber 76 is approximately equivalent to the pressure at the low-pressure outlet 22 of the fuel pump 14, the check valve 84 closes.

The control valve 26 is at first switched such that the control pressure connection 30 of the fuel injection device 16 communicates with the fuel tank 12. The control chamber 96 is accordingly extensively pressureless, and the pressure booster piston 54 is in the upper outset position shown in FIG. 2. For performing an injection, the control valve 26 is switched such that the control pressure connection 30 communicates with the control pressure outlet 20 of the fuel pump 14. The corresponding pressure now prevails, via the control conduit 94, in the control chamber 96 as well. The pressure at the control pressure outlet 20 of the fuel pump 14 is considerably higher than the pressure at the low-pressure outlet 22.

For this reason, and because of the ratios in the surface areas of the axial end faces 66 and 68 of the pressure booster piston 54, the result at the pressure booster piston 54 is a force oriented toward the high-pressure chamber 76, so that the pressure booster piston 54 moves in the direction of the high-pressure chamber 76. As a result, the fuel present in the high-pressure chamber 76 is compressed, and a very high pressure in the high-pressure chamber 76 is generated. In the lower end position of the pressure booster piston 54, shown in FIG. 3, the pressure in the high-pressure chamber 76 can be as high as approximately 1800 bar.

Because of the high pressure in the high-pressure chamber 76, that is, in the work chamber 79, the result at the pressure face 78 of the valve needle 70 is a force oriented in the opening direction of the valve needle 70, counter to the direction of action by the compression spring 72. Because of this force, the valve needle 70 is lifted from the valve seat, and as a result the outlet openings 52 are made to communicate with the high-pressure chamber 76. Thus the fuel reaches the combustion chamber 18 from the outlet openings 52 at very high pressure.

If the injection is to be terminated, the control valve 26 is switched against in such a way that the control pressure connection 30 of the fuel injection device 16 communicates with the fuel tank 12. This causes a sudden relief of the control chamber 96. By means of the compression spring 62, the pressure booster piston 54 is pressed upward again in terms of FIGS. 2 and 3. As a result, the pressure in the high-pressure chamber 76, that is, the work chamber 79, also drops, so that the valve needle 70 closes. Once the pressure in the high-pressure chamber 76 has dropped enough, the check valve 84 opens. Replenishing fuel can then flow into the high-pressure chamber 76 through the low-pressure conduit 86.

As a result of the sudden pressure drop in the control chamber 96, a relief pressure wave is generated. This causes the check valve 98 to open briefly, and cold fuel from the scavenging conduit 100 reaches the control chamber 96. This has the advantage that the temperature increase of the fuel enclosed in the control chamber 96, caused by the repeated compression and decompression, is compensated for by the delivery of cool fuel, and thus the temperature increase of the entire fuel injection device 16 in operation can be kept within certain limits.

As a result of certain leaks between the parts that move relative to one another, fuel also reaches the space 65 between the lower part 42 of the nozzle body 40 and the lower part 58 of the pressure booster piston 54, in which the compression spring 62 is disposed. When upon an injection the pressure booster piston 54 moves downward in terms of FIGS. 2 and 3, the volume of this space also decreases. Fuel present in it is therefore carried away to the leak fluid outlet 36 via the longitudinal groove 102 and the check valve 104.

In the ensuing injections or reciprocating motions of the pressure booster piston 54, essentially no further fuel is pumped out of the space to the leak fluid outlet 36. Instead, fuel vapor forms in this space, and this vapor is compressed during the reciprocating motions of the pressure booster piston 54 from vapor pressure to approximately ambient pressure. As a result, pressure fluctuations in the low-pressure loop are avoided.

Figure 4:
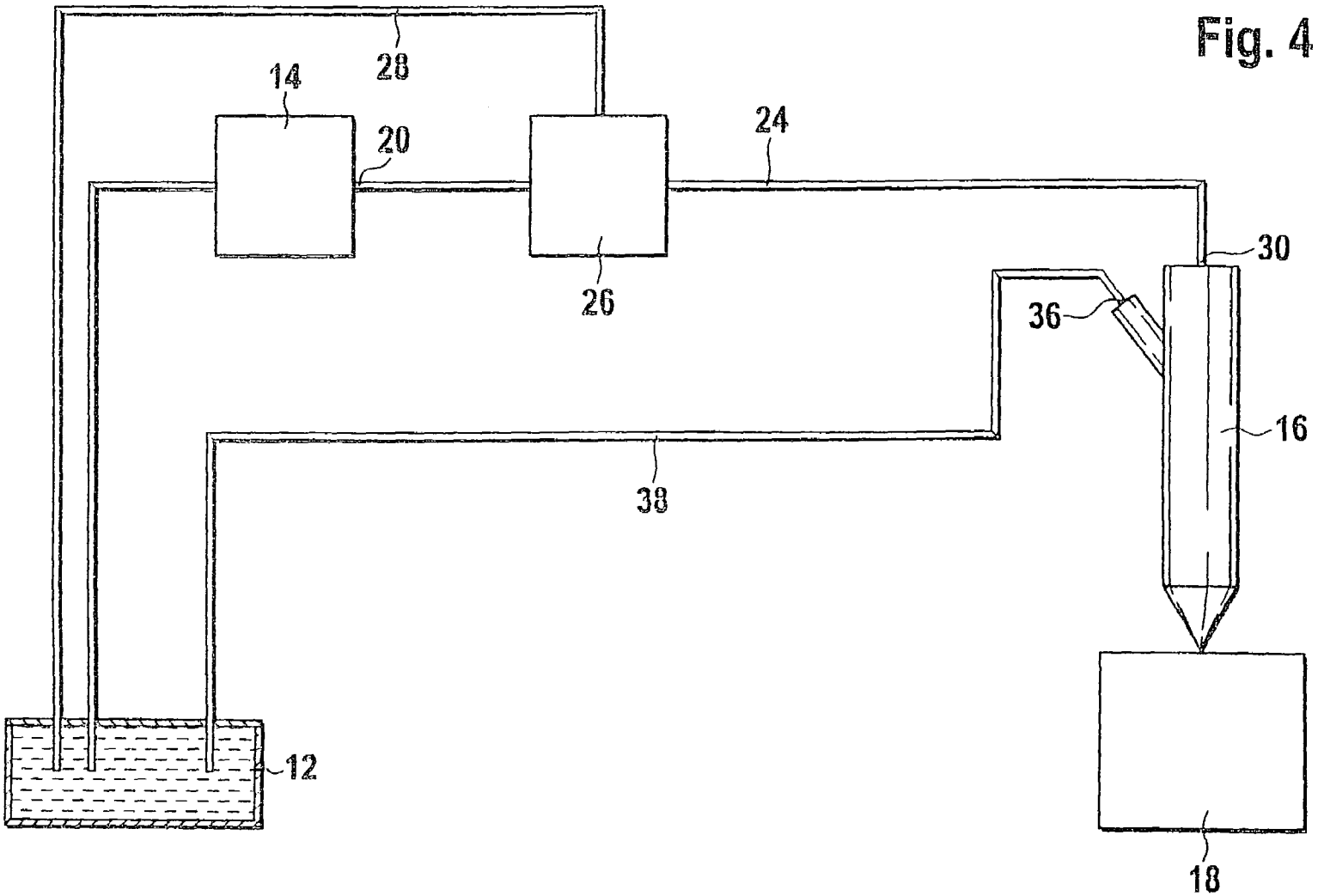
FIG. 4, is a basic sketch similar to FIG. 1 of a second exemplary embodiment of a fuel injection system for an internal combustion engine with a fuel injection device.
Figure 5:
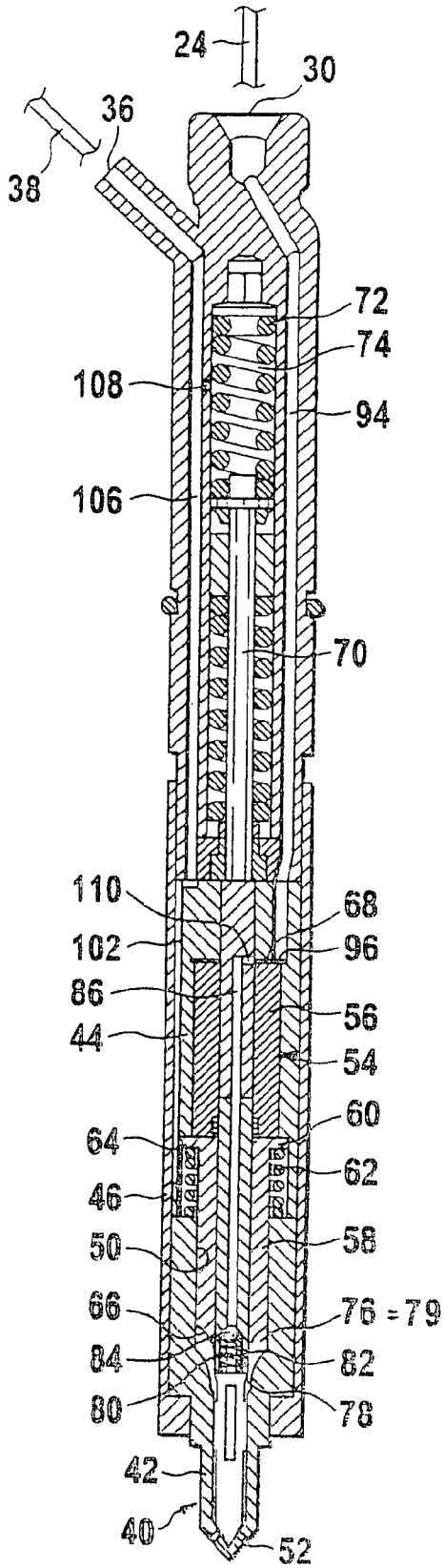
FIG. 5, a fragmentary section through the fuel injection device of FIG. 4, with a pressure booster piston in a first position.
Figure 6:
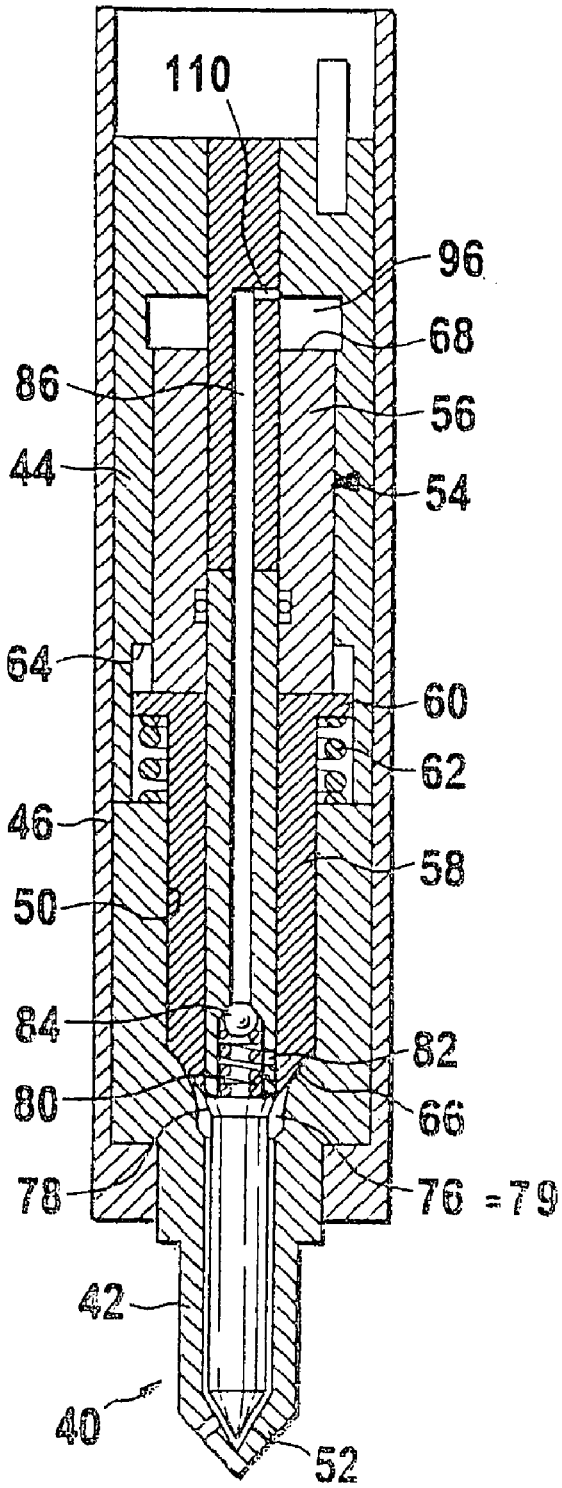
FIG. 6, a view similar to FIG. 5 of a region of the fuel injection device of FIG. 4 with the pressure booster piston in a second position.

In FIGS. 4–6, a second exemplary embodiment of a fuel injection system 10 is shown. Parts, elements and regions that have equivalent functions to parts, elements and regions of the exemplary embodiment shown in FIGS. 1–3 are identified by the same reference numerals. They are not described here again in detail.

One essential difference between the fuel injection system 10 shown in FIG. 4 and the above system is that the fuel pump 14 now has only a control pressure outlet 20 but no low-pressure outlet. Correspondingly, the fuel injection device 16 has only a control pressure connection 30 and a leak fluid outlet 36. Consequently, in FIG. 5, there is no low-pressure outlet.

In the fuel injection device 16 shown in FIGS. 5 and 6, there is no check valve between the longitudinal groove 102 and the leak fluid outlet 36. Instead, the longitudinal groove 102 extends via a leakage conduit 106 directly to the leak fluid outlet 36. The leak fluid outlet is furthermore in communication, via a radial bore 108 in the wall of the connection part 48, with the interior of the blind bore 74 in the connection part 48.

Supplying the high-pressure chamber 76 with fuel is effected in the fuel injection device 16 shown in FIGS. 5 and 6 via the control chamber 96. To that end, there is a radial inlet bore 110 in the wall of the valve needle 70, at the level of the control chamber 96. In addition, the conduit 86 in the valve needle 70 extends from the check valve 84 only to the level of the control chamber 96. The advantage of this exemplary embodiment is that a low-pressure system (low-pressure outlet at the fuel pump, low-pressure line, low-pressure connection at the fuel injection device, etc.) can be dispensed with.

The high-pressure chamber 76, as already noted above, is the chamber in which an enclosed fluid is compressed by the pressure booster piston 54, and a very high pressure is thus generated. The work chamber 79 is the chamber in which, by a pressure change at the pressure face 78 of the valve needle 70, a force is generated that leads to a motion of the valve needle 70. In both fuel injection devices 16 described above, the high-pressure chamber 76 of the pressure booster piston 54 is integrated with the work chamber 79 of the valve needle 70. The two chambers accordingly coincide. Thus upon an injection through the fuel injection device 16, only a comparatively small total volume is compressed, which reduces unwanted effects of elasticity of the fuel enclosed in the high-pressure chamber 76.

The foregoing relates to preferred exemplary embodiments of the invention, it being understood that other variants and embodiments thereof are possible within the spirit and scope of the invention, the latter being defined by the appended claims.

We claim:

1. A fuel injection system (10) for an internal combustion engine with direct injection, the system comprising a fuel injection device (16) which can inject fuel directly into a combustion chamber (18) of the engine, the fuel injection device having a valve element (70) which borders on a work chamber (79) and the position of the valve element (70) depending on the pressure in the work chamber (79), a pressure booster piston (54), which on one side borders on a control chamber (96) and on the other side borders on a high-pressure chamber (76), a fuel supply (14), which can subject the control chamber (96) to various pressures, the pressure booster piston (54) being integrated with the fuel injection device (16), and the high-pressure chamber (76) being integrated with the work chamber (79).

2. The fuel injection system (10) of claim 1, wherein the pressure booster piston (54) is disposed coaxially to the valve element (70).

3. The fuel injection system (10) of claim 2, wherein the valve element (70) is guided in the pressure booster piston (54).

4. The fuel injection system (10) of claim 3, further comprising a longitudinal bore (86) in the valve element (70), the longitudinal bore supplying fuel to the high-pressure chamber (76).

5. The fuel injection system (10) of claim 4, further comprising a check valve (84) between the longitudinal bore (86) in the valve element (70) and the high-pressure chamber (76), the check valve (84) opening toward the high-pressure chamber (76).

6. The fuel injection system (10) of claim 5, wherein the longitudinal bore (86) in the valve element (70) communicates with a low-pressure fuel supply (22).

7. The fuel injection system (10) of claim 4, wherein the longitudinal bore (86) in the valve element (70) communicates with a low-pressure fuel supply (22).

8. The fuel injection system (10) of claim 2, further comprising a longitudinal bore (86) in the valve element (70), the longitudinal bore supplying fuel to the high-pressure chamber (76).

9. The fuel injection system (10) of claim 8, further comprising a check valve (84) between the longitudinal bore (86) in the valve element (70) and the high-pressure chamber (76), the check valve (84) opening toward the high-pressure chamber (76).

10. The fuel injection system (10) of claim 9, wherein the longitudinal bore (86) in the valve element (70) communicates with a low-pressure fuel supply (22).

11. The fuel injection system (10) of claim 9, wherein the longitudinal bore (86) in the valve element (70) communicates with a control-pressure fuel supply (20, 26), which can also subject the control chamber (96) to various pressures.

12. The fuel injection system (10) of claim 11, wherein the control chamber (96) coaxially surrounds the valve element (70), and wherein the longitudinal bore (86) in the valve element (70) communicates with the control chamber (96) via a radially extending opening (110).

13. The fuel injection system (10) of claim 9, further comprising a low-pressure fuel supply (22), a check valve (98) between the control chamber (96) and the low-pressure fuel supply (22), the check valve (98) opening toward the control chamber (96).

14. The fuel injection system (10) of claim 8, wherein the longitudinal bore (86) in the valve element (70) communicates with a low-pressure fuel supply (22).

15. The fuel injection system (10) of claim 8, wherein the longitudinal bore (86) in the valve element (70) communicates with a control-pressure fuel supply (20, 26), which can also subject the control chamber (96) to various pressures.

16. The fuel injection system (10) of claim 15, wherein the control chamber (96) coaxially surrounds the valve element (70), and wherein the longitudinal bore (86) in the valve element (70) communicates with the control chamber (96) via a radially extending opening (110).

17. The fuel injection system (10) of claim 8, further comprising a low-pressure fuel supply (22), a check valve (98) between the control chamber (96) and the low-pressure fuel supply (22), the check valve (98) opening toward the control chamber (96).

18. A fuel injection system (10) for an internal combustion engine with direct injection, the system comprising a fuel injection device (16) which can inject fuel directly into a combustion chamber (18) of the engine, the fuel injection device having a valve element (70) which borders on a work chamber (79) and the position of the valve element (70) depending on the pressure in the work chamber (79), a pressure booster piston (54), which on one side borders on a control chamber (96) and on the other side borders on a high-pressure chamber (76), a fuel supply (14), which can subject the control chamber (96) to various pressures, the pressure booster piston (54) being integrated with the fuel injection device (16), and the high-pressure chamber (76) being integrated with the work chamber (79), wherein the pressure booster piston (54) is braced via a spring (62) on a nozzle body (40) of the fuel injection device (16).

19. The fuel injection system (10) of claim 18, further comprising a hollow chamber (65) between the pressure booster piston (54) and the nozzle body (40), the hollow chamber (65) being variable in volume upon a motion of the pressure booster piston (54) and communicating with a leak fluid outlet (36) via a check valve (104), the check valve (104) opening toward the leak fluid outlet (36).

20. A fuel injection system (10) for an internal combustion engine with direct injection, the system comprising a fuel injection device (16) which can inject fuel directly into a combustion chamber (18) of the engine, the fuel injection device having a valve element (70) which borders on a work chamber (79) and the position of the valve element (70) depending on the pressure in the work chamber (79), a pressure booster piston (54), which on one side borders on a control chamber (96) and on the other side borders on a high-pressure chamber (76), a fuel supply (14), which can subject the control chamber (96) to various pressures, the pressure booster piston (54) being integrated with the fuel injection device (16), and the high-pressure chamber (76) being integrated with the work chamber (79), further comprising a low-pressure fuel supply (22), a check valve (98) between the control chamber (96) and the low-pressure fuel supply (22), the check valve (98) opening toward the control chamber (96).

* * * * *